US008366193B2

(12) United States Patent
Lin

(10) Patent No.: US 8,366,193 B2
(45) Date of Patent: Feb. 5, 2013

(54) LEISURE ROCKING CHAIR

(76) Inventor: Chang-Chen Lin, Guanmiao Township, Tainan County (TW)

( * ) Notice: Subject to any disclaimer, the term of this patent is extended or adjusted under 35 U.S.C. 154(b) by 353 days.

(21) Appl. No.: 12/876,195

(22) Filed: Sep. 6, 2010

(65) Prior Publication Data

US 2012/0025573 A1 Feb. 2, 2012

(30) Foreign Application Priority Data

Jul. 28, 2010 (TW) ..... 99214399 U

(51) Int. Cl.
*A47C 3/027* (2006.01)

(52) U.S. Cl. ..... 297/261.1; 297/258.1; 297/259.1; 297/259.2; 297/270.1; 297/270.3

(58) Field of Classification Search ..... 297/228.1, 297/259.1, 259.2, 259.3, 261.1, 273, 270.1, 297/270.3, 270.4, 258.1, 269.1
See application file for complete search history.

(56) References Cited

U.S. PATENT DOCUMENTS 2,302,387 A * 11/1942 Greeno et al. ..... 248/370
4,108,415 A * 8/1978 Hauray et al. ..... 248/370
4,707,026 A * 11/1987 Johansson ..... 297/281
5,765,913 A * 6/1998 LaPointe et al. ..... 297/281
5,947,557 A * 9/1999 Bellefleur ..... 297/281
6,092,870 A * 7/2000 Desnoyers et al. ..... 297/281
6,120,094 A * 9/2000 Parent ..... 297/270.1
6,213,551 B1 * 4/2001 Desnoyers et al. ..... 297/270.4
6,244,658 B1 * 6/2001 Parent et al. ..... 297/270.1
6,402,242 B1 * 6/2002 Bellefleur ..... 297/270.1
6,588,841 B1 * 7/2003 Hoffman et al. ..... 297/270.3
6,722,734 B2 * 4/2004 Bellefleur ..... 297/270.1
7,090,295 B2 * 8/2006 Bodinek ..... 297/273
7,134,720 B2 * 11/2006 Viger ..... 297/270.1
2003/0015900 A1 * 1/2003 Lu ..... 297/259.1

* cited by examiner

*Primary Examiner* — Laurie Cranmer

(57) ABSTRACT

A leisure rocking chair includes a seat, a backrest, a fixed seat, a rocking base and a rocking mechanism. The fixed base includes a horizontal beam on an upper portion thereof. The rocking mechanism includes front and rear rocking rods and a connecting rod. The front and rear rocking rods, the horizontal beam, and the connecting rod are pivotably connected. A fixed support is mounted to the connecting rod. The rocking base is fixed to the fixed support. A positioning plate is mounted to the fixed base and includes a plurality of positioning holes. The rocking mechanism includes an adjusting seat adjacent to the positioning plate. An adjusting lever is mounted to the adjusting seat and includes a tail portion extendible into one of the plurality of positioning holes to fix the rocking mechanism. The adjusting lever includes a control arm on a head portion thereof.

7 Claims, 14 Drawing Sheets

LEISURE ROCKING CHAIR

BACKGROUND OF THE INVENTION

1. Field of the Invention

The present invention relates to a chair and, more particularly, to a rocking chair for leisure.

2. Description of the Related Art

Leisure chairs are ordinary furniture for leisure in homes. People can rest in leisure chairs. To enhance the leisure function, the backrest of the leisure chair is often adjustable so that the user can adjust the backrest to a desired inclination angle and then position the backrest in the inclination angle. The mechanism for positioning the backrest generally includes a bolt or knob that is loosened for adjustment of the inclination angle and then tightened to fix the inclination angle, which is troublesome in operation. Furthermore, the leisure function is still insufficient, failing to provide additional enjoyment for the user. A type of currently available leisure rocking chair includes a pivotable linking mechanism supporting a seat. The linking mechanism can rock to and fro for rocking the user. When rocking is not desired, the linking mechanism is positioned by a cable brake mechanism similar to a brake cable for bicycles. The brake cable mechanism includes a control end in a location that can be easily touched by a hand of a user for controlling a catch to engage with or disengage from the linking mechanism via a cable and, hence, controlling rocking of the linking mechanism. However, such a cable brake mechanism is complicated and requires troublesome installation. Furthermore, the user must apply large force to operate the cable brake mechanism, leading to inconvenient use. Further, in some cases, the linking mechanism can not be reliably positioned or can not be loosened due to over tightening.

BRIEF SUMMARY OF THE INVENTION

An objective of the present invention is to provide a leisure rocking chair that is simple and reasonable in structure, easy to use, and adjustable in the inclination angle of the backrest.

To fulfill the above objective, a leisure rocking chair of the present invention includes a leisure rocking chair including a seat, a backrest, and a fixed seat. The backrest is pivotably connected to the seat to form a structure allowing adjustment in an inclination angle. The leisure rocking chair further includes a rocking base and a rocking mechanism.

The fixed base includes a horizontal beam on an upper portion thereof and extending in a front/rear direction. The rocking mechanism includes front and rear rocking rods and a connecting rod. The front rocking rod has an upper end pivotably connected to a front end of the horizontal beam. The rear rocking rod has an upper end pivotably connected to a rear end of the horizontal beam. The front rocking rod has a lower end pivotably connected to an end of the connecting rod. The rear rocking rod has a lower end pivotably connected to another end of the connecting rod. A fixed support is mounted above an intermediate portion of the connecting rod. The rocking base is fixed to the fixed support.

A positioning plate is mounted to the fixed base and faces sideways. The positioning plate includes a plurality of positioning holes arranged in a rocking direction of the rocking mechanism. The rocking mechanism includes an adjusting seat adjacent to the positioning plate. An adjusting lever is mounted to the adjusting seat and includes a tail portion extendible into one of the plurality of positioning holes to fix the rocking mechanism. The adjusting lever includes a control arm on a head portion thereof.

In a further improvement to the above arrangement, the adjusting seat includes a through-hole having an inclined end face. The adjusting lever is extended through the through-hole. The adjusting lever includes an inclined rotating portion engaged with the inclined end face of the through-hole for converting rotational movement of the adjusting lever into axial movement. The adjusting lever can be rotated to control rocking of the leisure rocking chair.

In a further improvement to the above arrangement, the seat includes a guiding rod on each of two sides thereof. A sleeve is mounted to an inner surface of each of two sides of the rocking base and mounted around one of the guiding rods. A sliding rod is pivotably connected to one of the guiding rods. A guiding seat is mounted on the rocking base and receives the sliding rod. The guiding seat includes a switch device and a switch control rod for clamping or loosening the sliding rod. The rocking base is pivotably connected to an intermediate portion of the backrest. Adjustment and locking of the angle of the backrest can be easily achieved by rotating the switch control rod.

The leisure rocking chair provided by the present invention is simple and reasonable in structure and not easy to malfunction. It not only allows easy adjustment in the angle of the backrest but also provides rocking function, permitting the user to adjust the angle of the backrest and the rocking extent of the chair according to the needs. Furthermore, the leisure rocking chair of the present invention can be easily locked. Further, the leisure rocking chair of the present invention is force-saving such that the user can proceed with adjustment and locking more conveniently without obstacles in use. Thus, the present invention provides a product of leisure rocking chair that is convenient and reliable.

The present invention will become clearer in light of the following detailed description of illustrative embodiments of this invention described in connection with the drawings.

DETAILED DESCRIPTION OF THE INVENTION

Figure 1:
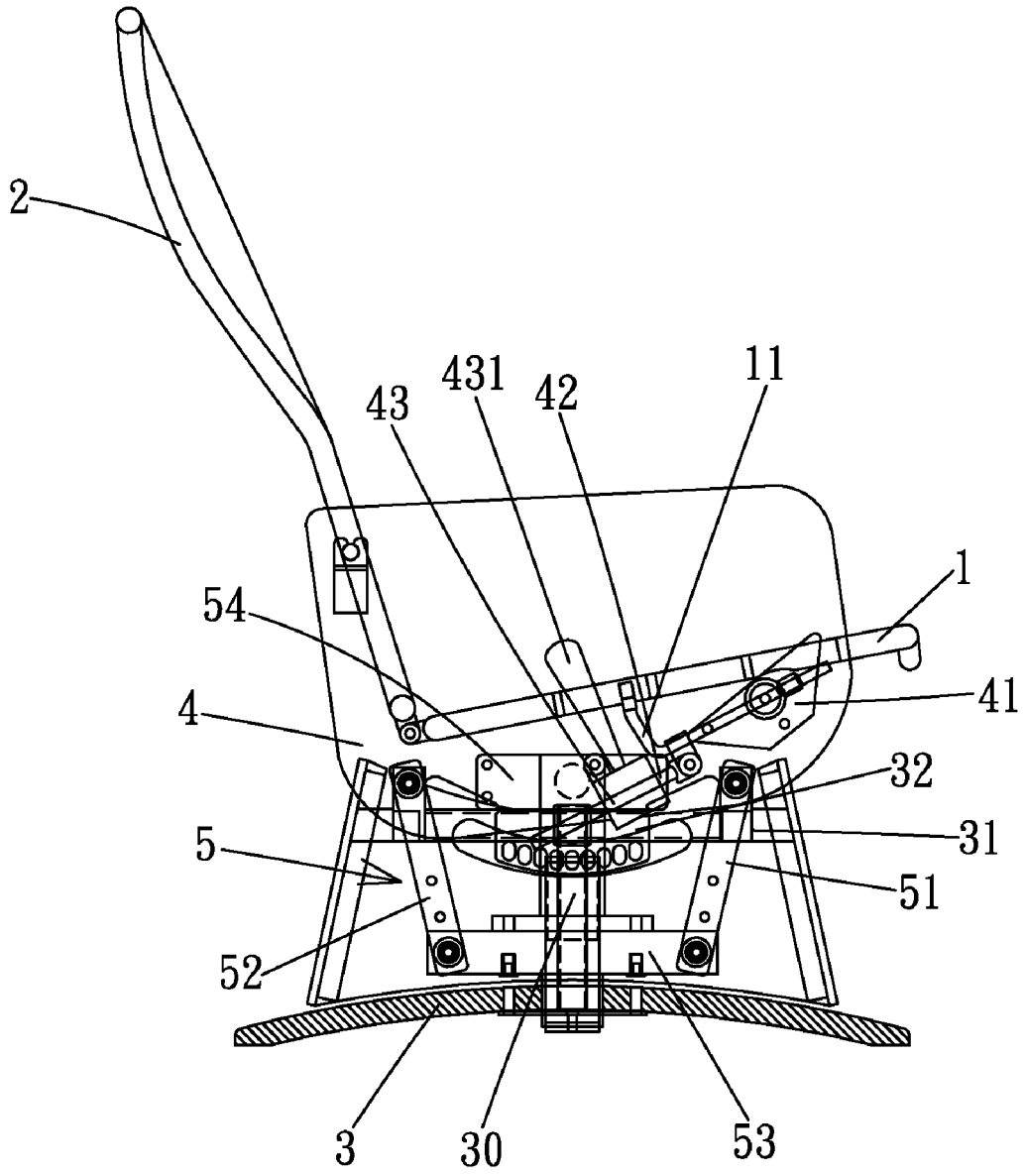
FIG. 1 is a schematic side view of a leisure rocking chair of the present invention.
Figure 2:
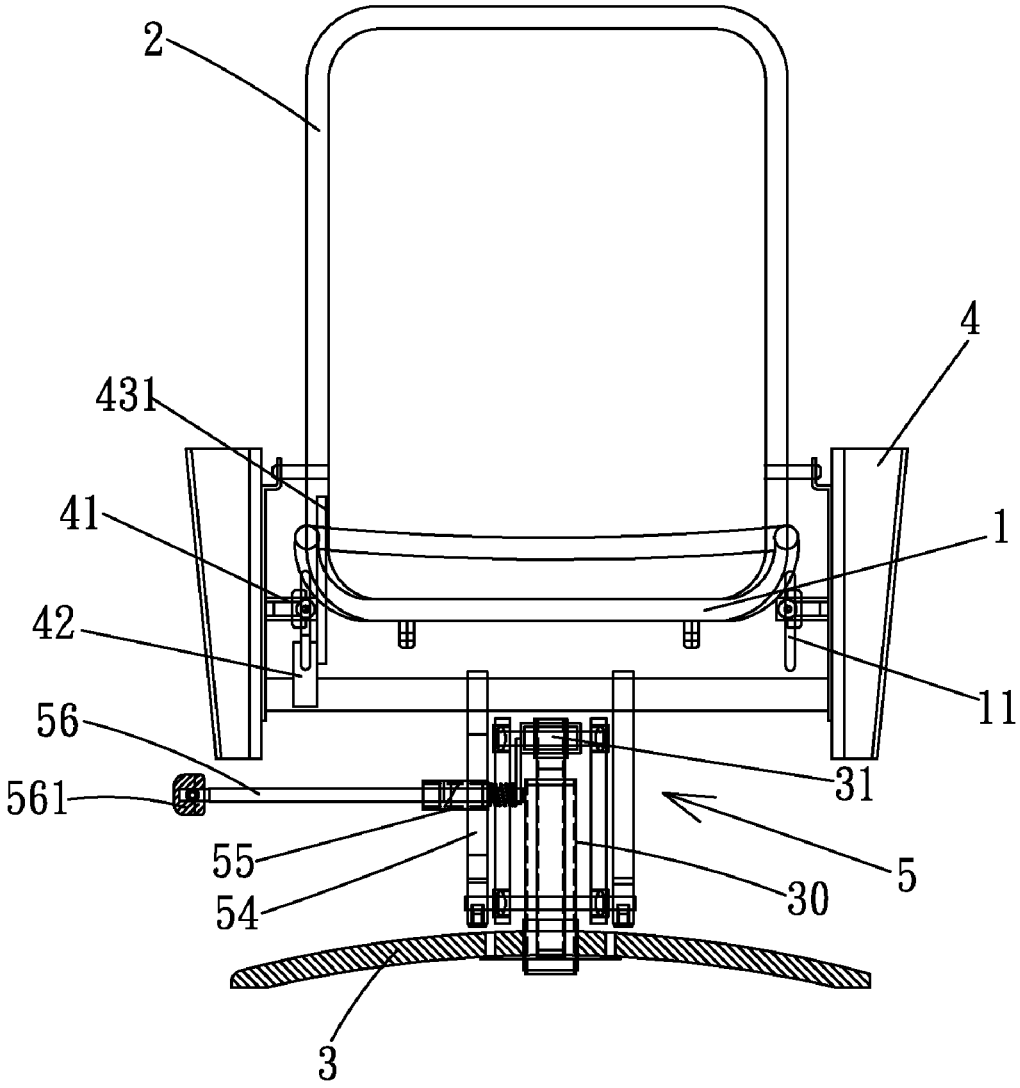
FIG. 2 is a schematic front view of the leisure rocking chair of the present invention.

With reference to FIGS. 1 and 2, a leisure rocking chair according to the present invention includes a seat 1, a backrest 2, a fixed base 3, a rocking base 4, and a rocking mechanism 5. The fixed base 3 is the base for the whole leisure rocking chair. The backrest 2 is pivotably connected to the seat 1 to form a structure allowing adjustment in an inclination angle. The backrest 2 and the seat 1 are mounted on the rocking base 4. The rocking base 4 can rock relative to the rocking mechanism to provide the leisure rocking chair with rocking function.

Figure 3:
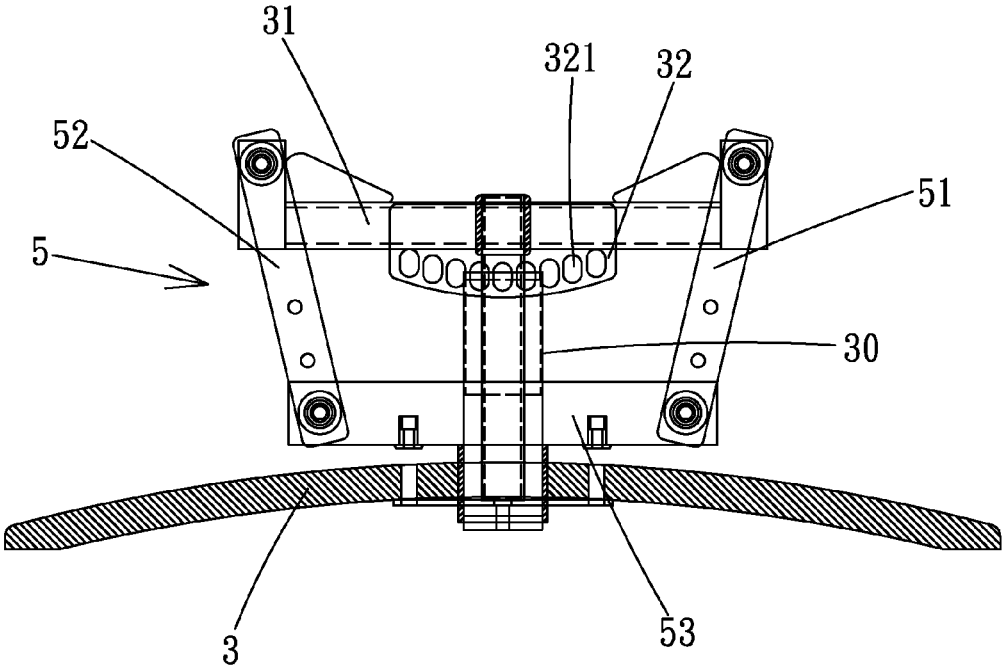
FIG. 3 is a schematic view showing structure of a rocking mechanism and a fixed base.

The fixed base 3 includes a horizontal beam 31 on an upper portion of a column 30 and extending in a front/rear direction to obtain a structure that is easy to balance. With reference to FIG. 3, the rocking mechanism 5 includes front and rear rocking rods 51 and 52 and a connecting rod 53. The front rocking rod 51 has an upper end pivotably connected to a front end of the horizontal beam 31. The rear rocking rod 52 has an upper end pivotably connected to a rear end of the horizontal beam 31. Lower ends of the front rocking rod 51 are pivotably connected to two ends of the connecting rod 53. A link mechanism is, thus, provided with the horizontal beam 31 acting as a fixed portion. The front and rear rocking rods 51 and 52 can rotate through an angle due to the pivotal connections. The connecting rod 53 between the front and rear rocking rods 51 and 52 can pivot in the front/rear direction. The leisure rocking chair can include two sets of front and rear rocking rods 51 and 52 and the connecting rods 3 that are symmetrically located on two sides of the horizontal beam 31 to form a symmetric, integral structure. This arrangement also allows easy designing of the pivotal connections between the front and rear connecting rods 51 and 52 and the horizontal beam 31.

Figure 4:
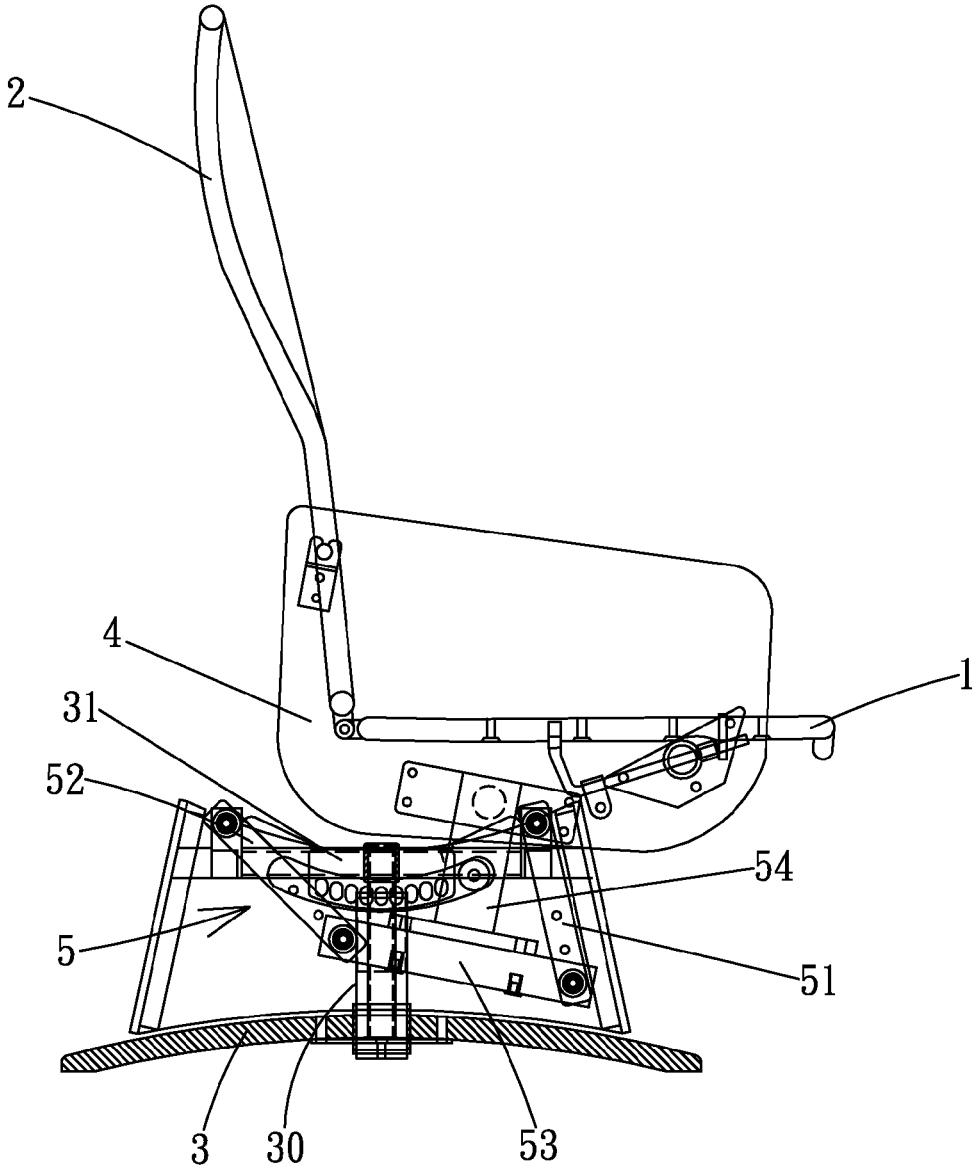
FIG. 4 is a schematic side view illustrating forward rocking of the leisure rocking chair of the present invention.
Figure 5:
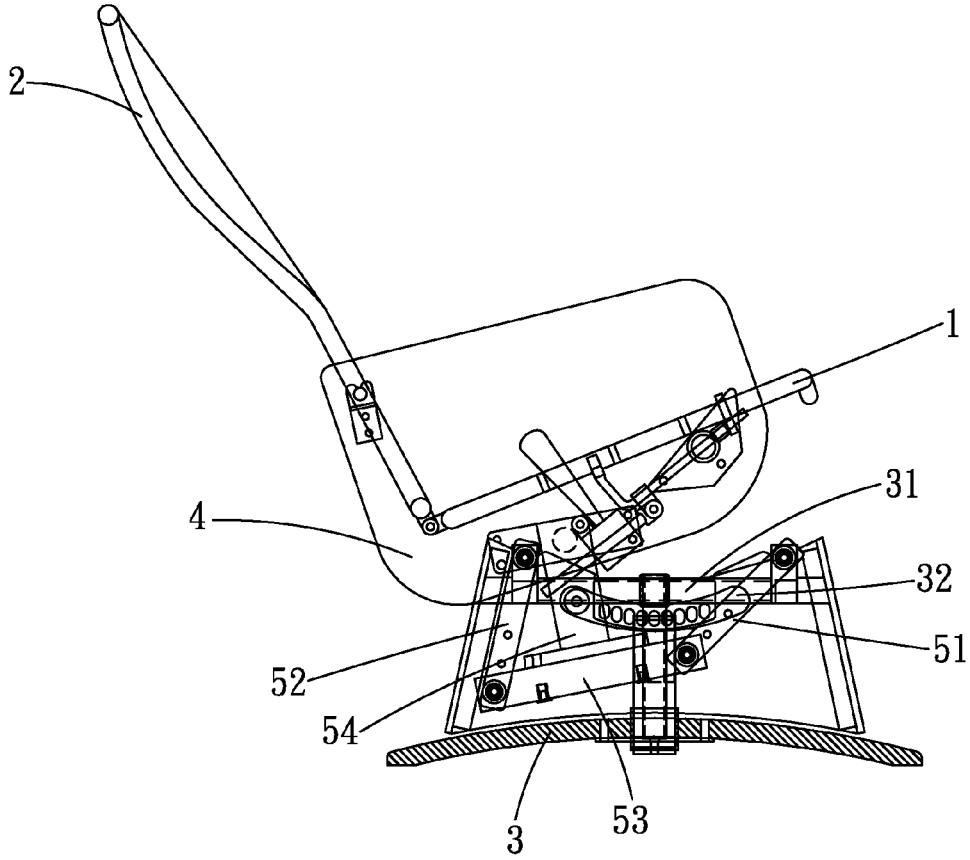
FIG. 5 is a schematic side view illustrating rearward rocking of the leisure rocking chair of the present invention.
Figure 6:
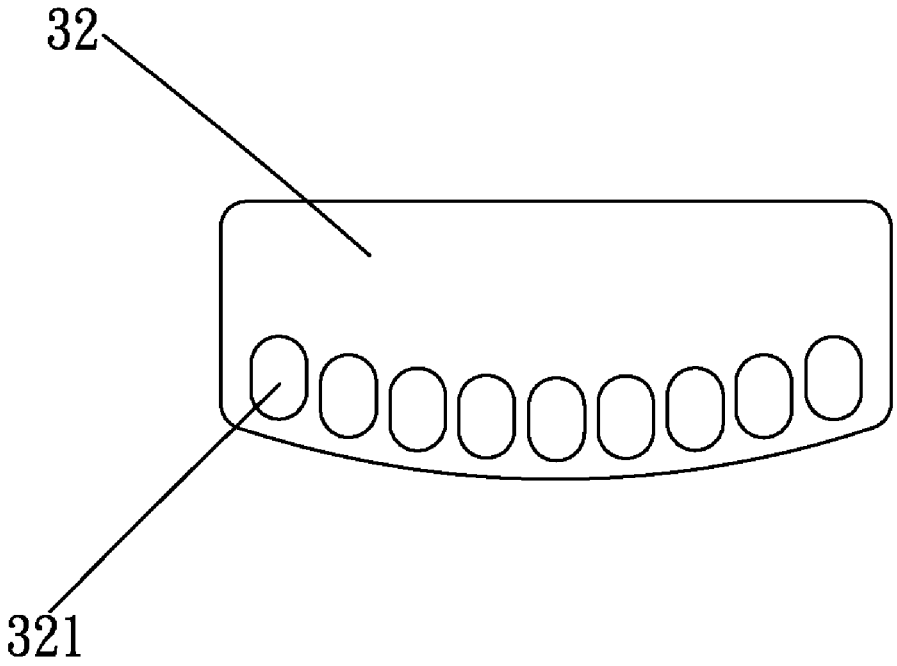
FIG. 6 is a schematic view of a positioning plate.
Figure 7:
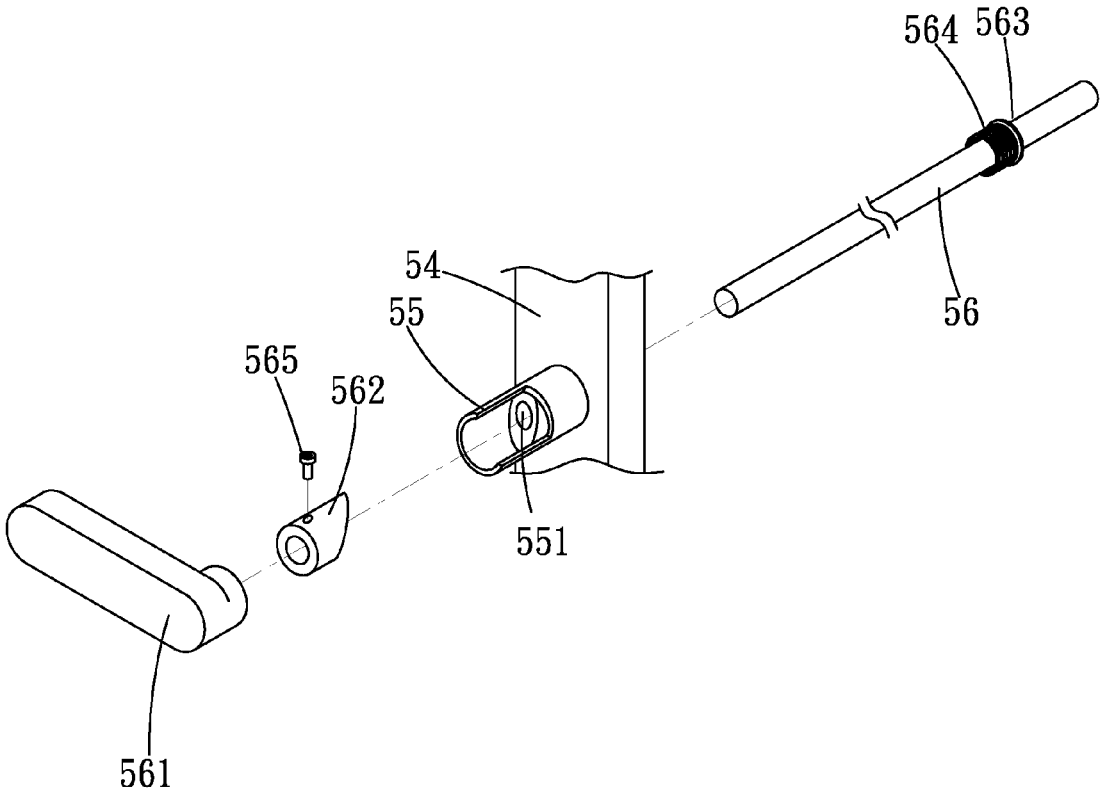
FIG. 7 is a schematic, exploded, perspective view of an adjusting seat.
Figure 8:
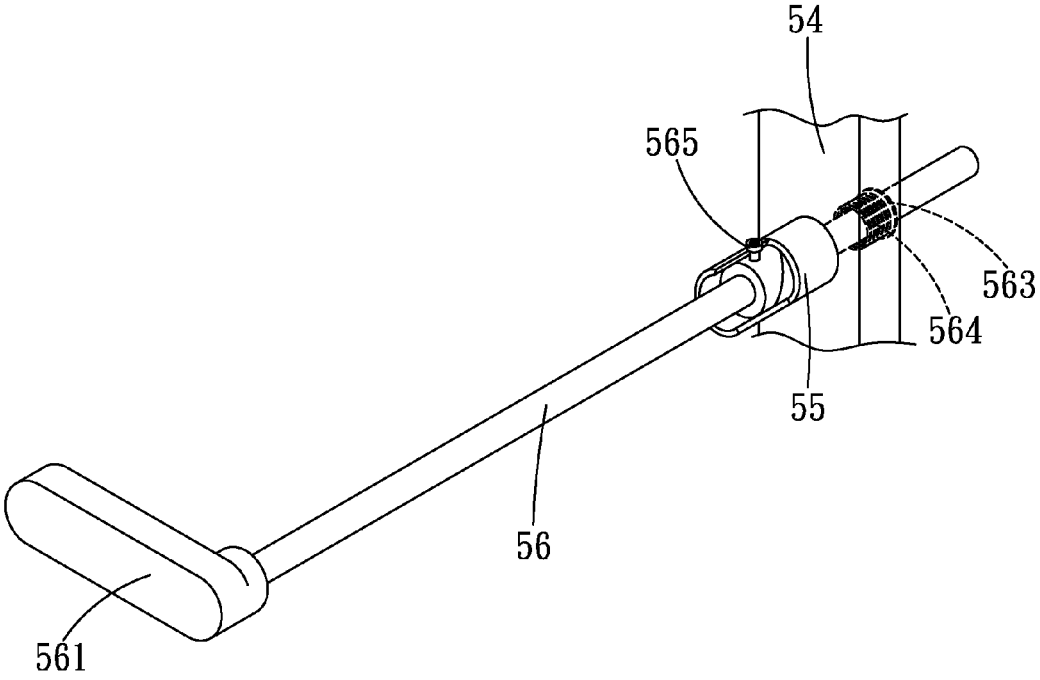
FIG. 8 shows the adjusting seat of FIG. 7 after assembly.

A fixed support 54 is mounted above an intermediate portion of the connecting rod 53. The rocking base 4 is fixed to the fixed support 54. Thus, when the connecting rod 53 rocks in the front/rear direction, the rocking base 4 is driven to rock in the front/rear direction in a way shown in FIGS. 4 and 5.

Figure 9:
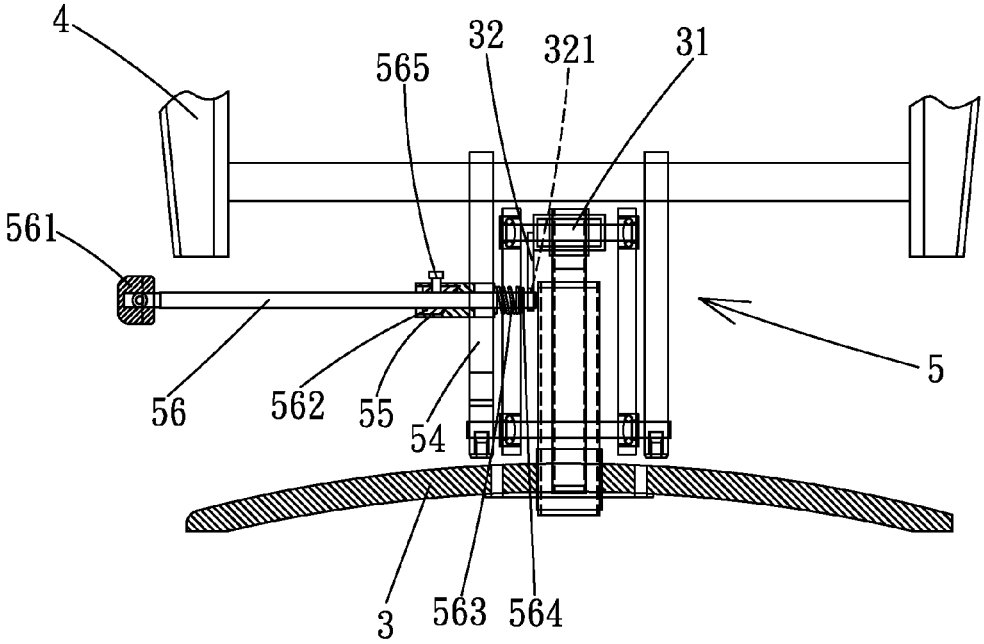
FIG. 9 is a schematic view of the leisure rocking chair of the present invention with the rocking mechanism in a locked state.

To control the rocking movement, a positioning plate 32 is mounted to the fixed base 3 and faces sideways. With reference to FIGS. 6-9, the positioning plate 32 includes a plurality of positioning holes 321 arranged in a rocking direction of the rocking mechanism 5. The rocking mechanism 5 includes an adjusting seat 55 adjacent to the positioning plate 32. An adjusting lever 56 is mounted to the adjusting seat 55 and includes a tail portion extendible into one of the plurality of positioning holes 321 to fix the rocking mechanism 5. The adjusting lever 56 includes a control arm 561 on a head portion thereof. The adjusting lever 56 can be controlled through the control arm 561. The tail portion of the adjusting lever 56 can be engaged in one of the positioning holes 321 to fix the adjusting seat 55 relative to the positioning plate 32. The adjusting plate 55 is fixed to the rocking mechanism 4, and the positioning plate 32 is fixed to the fixed base 3. Thus, the rocking mechanism 4 and the fixed base 3 can not move relative to each other, preventing rocking movement. The locking state is shown in FIG. 9.

By using the adjusting lever 56 to engage with the positioning holes 321 for locking purposes, the structure is simple and reasonable and not easy to malfunction. In a preferred example of engaging the adjusting lever 56 in the positioning holes 321 shown in FIGS. 7-9, the adjusting seat 55 includes a through-hole 551 having an inclined end face. The adjusting lever 56 is extended through the through-hole 551. The adjusting lever 56 includes an inclined rotating portion 562 engaged with the inclined end face of the through-hole 551 for converting rotational movement of the adjusting lever 56 into axial movement.

To fix the adjusting lever 56 on the adjusting seat 55, the inclined rotating portion 562 has a hole through which the adjusting lever 56 extends to fix the inclined rotating portion 562 around the adjusting lever 56. The inclined rotating portion 562 can include a screw hole in an outer periphery of the inclined rotating portion 562 and in communication with the hole. A tightening bolt 565 is mounted in the screw hole. The bolt 565 can be rotated and tightened to press against the adjusting lever 56 so as to fix the adjusting lever 56 in the hole of the inclined rotating portion 562. Furthermore, the inclined end face of the through-hole 551 of the adjusting seat 55 and the inclined rotating portion 562 are located at an outer side of the through-hole 551. A limiting flange 563 is formed on the adjusting lever 56 and located at an inner side of the through-hole 551. A spring 564 is mounted between the limiting flange 563 and the adjusting seat 55. The limiting flange 563 and the spring 564 retains the adjusting lever 56 to the adjusting seat 55, preventing the end from disengaging from the through-hole 551. The resiliency of the spring 564 assists in inserting the end of the adjusting lever 56 into the positioning hole.

Figure 10:
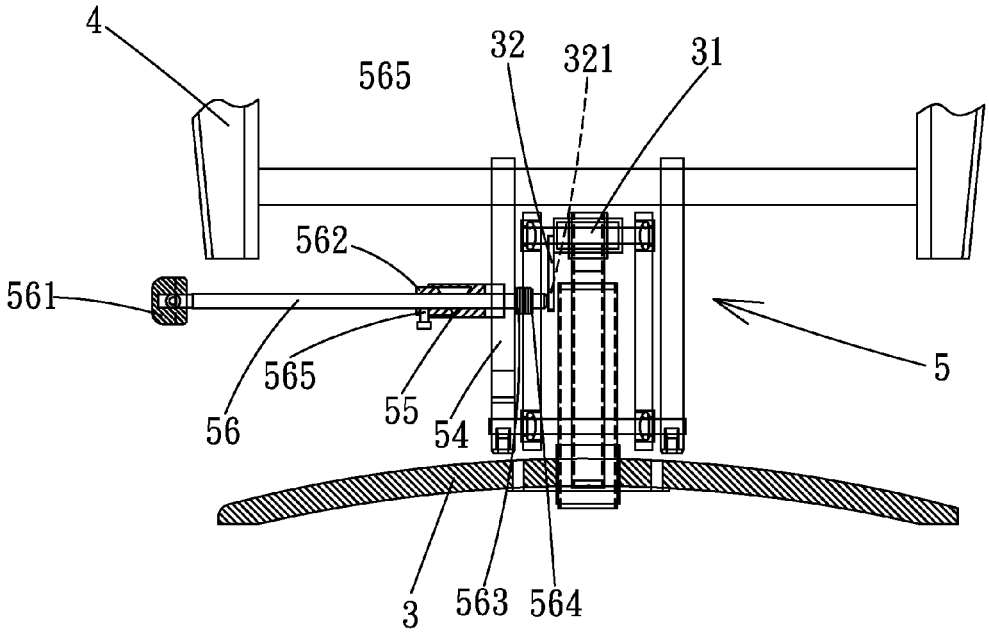
FIG. 10 is a schematic view of the leisure rocking chair of the present invention with the rocking mechanism in an unlocking state.
Figure 11:
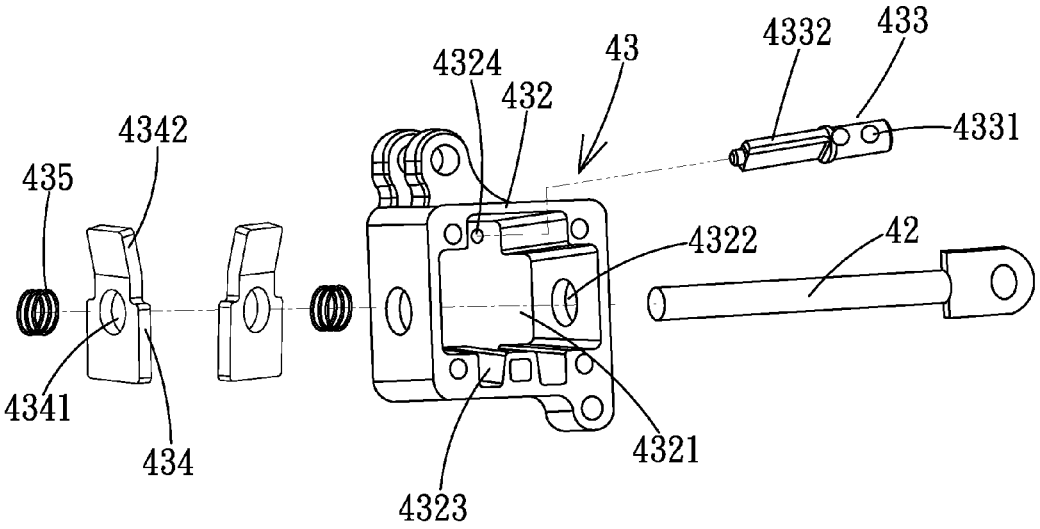
FIG. 11 is an exploded, perspective view of a guiding seat of the leisure rocking chair of the present invention.

By using the above structure, the control arm 561 can be a handle fixed to an end of the adjusting lever 56. Furthermore, the adjusting lever 56 can be designed to be longer such that the control arm 561 is located at an outer side of a lower portion of the rocking base 4, allowing easy holding by a hand of a user. By using the above structure, the user can control rocking with smaller force, obtaining a rocking control structure with excellent effect. With reference to FIG. 10, the handle 561 can rotate 180° during the rocking movement. Furthermore, the rotating portion 562 rotates such that the protruded inclined portion of the rotating portion 562 abuts a protruded inclined end of the adjusting seat 55, and the adjusting lever 56 is rotated and disengaged from the positioning hole 321, allowing rocking of the rocking base 4.

Adjustment of the angle of the backrest 2 can be achieved in many ways in leisure rocking chairs. In a preferred example shown in FIG. 1, the rocking base 4 is pivotably connected to an intermediate portion of the backrest 2. The seat 1 includes a guiding rod 11 on each of two sides thereof. A sleeve 41 is mounted to an inner surface of each of two sides of the rocking base 4 and mounted around one of the guiding rods 11. This allows balance of force. A sliding rod 42 is pivotably connected to one of the guiding rods 11. The direction of the sliding rod 42 can be substantially the same as the guiding rods 11. A guiding seat 43 is mounted on the rocking base 4 and receives the sliding rod 42. The guiding seat 43 includes a switch device and a switch control rod 431 for clamping or loosening the sliding rod 42. Through control of the switch control rod 431, the sliding rod 42 can be clamped tightly or loosened. Furthermore, since the seat 1 must be located between two sides of the rocking base 4, the rocking base 4 must be arranged in a manner that the intermediate portion of the rocking base 4 is lower than two sides of the rocking base 4. Thus, in actual use, the two sides of the rocking base 4 can be in the form of two armrests to provide support for the arms of the user.

With reference to FIGS. 11-14, the switch device of the guiding seat 43 includes a housing 432, an actuating rod 433, two pressing members 434, and two springs 435. The housing 432 is fixed to the rocking base 4 and includes a compartment

4321, a through-hole 4322, two engaging grooves 4323, and an axial hole 4324. The sliding rod 42 extends through the through-hole 4322 of the housing 43. The actuating rod 433 has an end engaged perpendicularly in the axial hole 4324 and is rotatable relative to the housing 432. The other end of the actuating rod 433 has an engaging portion 4331 engaged with the control rod 431. The actuating rod 433 further includes two abutting portions 4332 on an outer periphery thereof and located in different angular positions (spaced from each other by 180°) and having a larger diameter, the two pressing members 434 are two highly rigid plates located in the compartment 4321 and engaged in the two engaging grooves 4323. The actuating rod 433 is mounted between the two pressing members 434. Each pressing member 434 includes a through-hole 4341 having an inner diameter slightly larger than an outer diameter of the sliding rod 42. The sliding rod 42 extends through the through-holes 4341 of the pressing members 434. Each pressing member 434 further includes an abutting portion 4342 in a location corresponding to the actuating rod 433. The springs 435 are mounted around the sliding rod 42 and received in the compartment 4321. Each spring 435 has two ends respectively abutting against an inner wall of the compartment 4321 and one of the pressing members 434.

Figures 12, 12A:
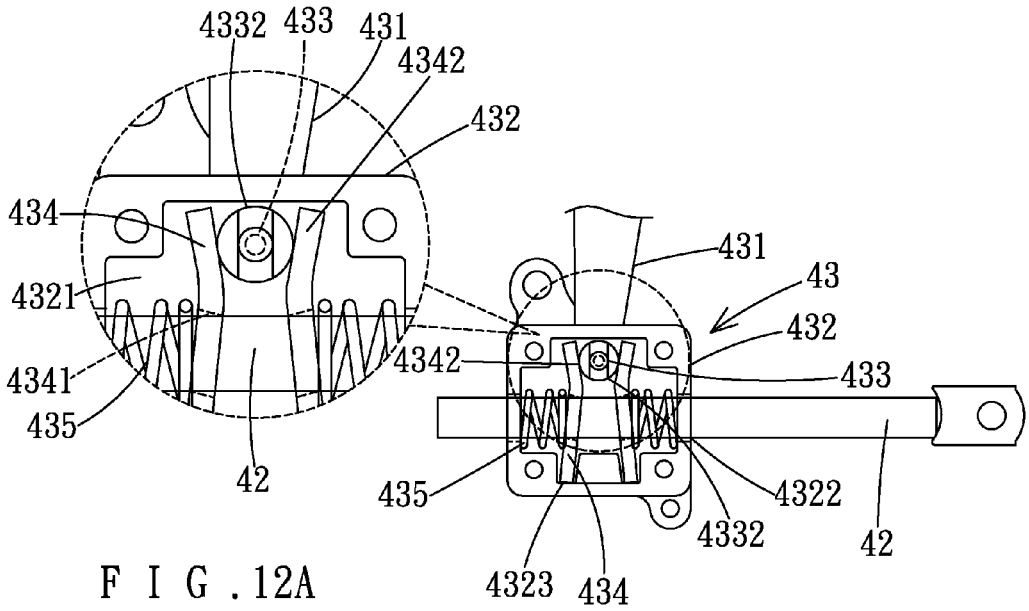
FIG. 12 is a schematic side view of the guiding seat with a sliding rod in a locked position.
FIG. 12A is an enlarged view of a circled portion in FIG. 12.

With reference to FIG. 12, to make the leisure rocking chair of the present invention in the locking state, the control rod 431 is operated to rotate the actuating rod 433 such that the abutting portions 4332 of the actuating rod 431 do not abut against the abutting portions 4342 of the pressing members 434. Thus, the pressing members 434 are biased by the resiliency of the springs 435, and an inner periphery of the through-hole 4341 of each pressing member 434 engages with the sliding rod 42. As a result, the sliding rod 42 can not move relative to the guiding seat 43, obtaining the locking state.

Figures 13, 13A:
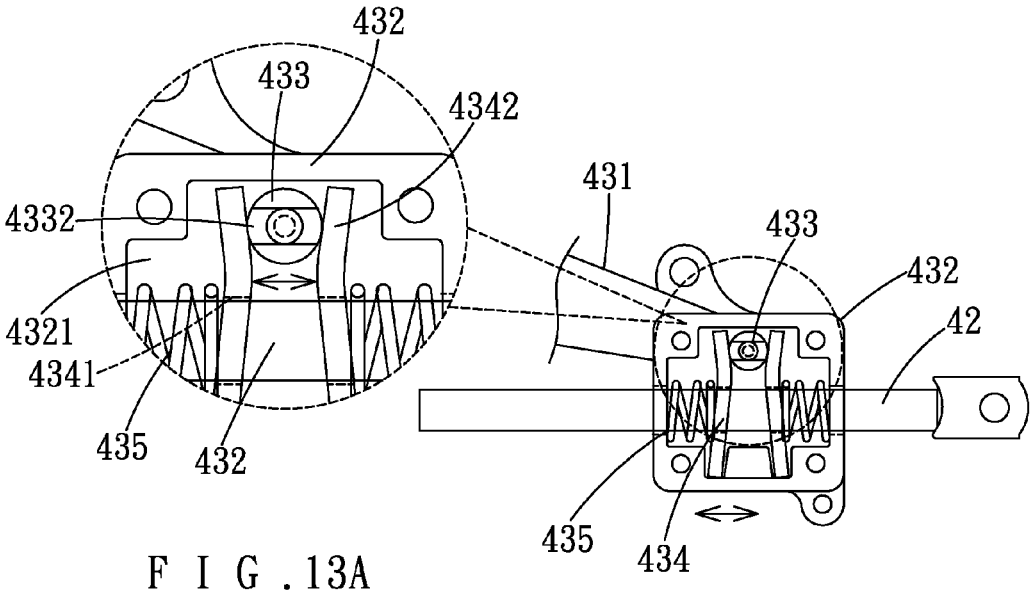
FIG. 13 is a schematic side of the guiding seat with the sliding rod in an unlocked position.
FIG. 13A is an enlarged view of a circled portion in FIG. 13.
Figure 14:
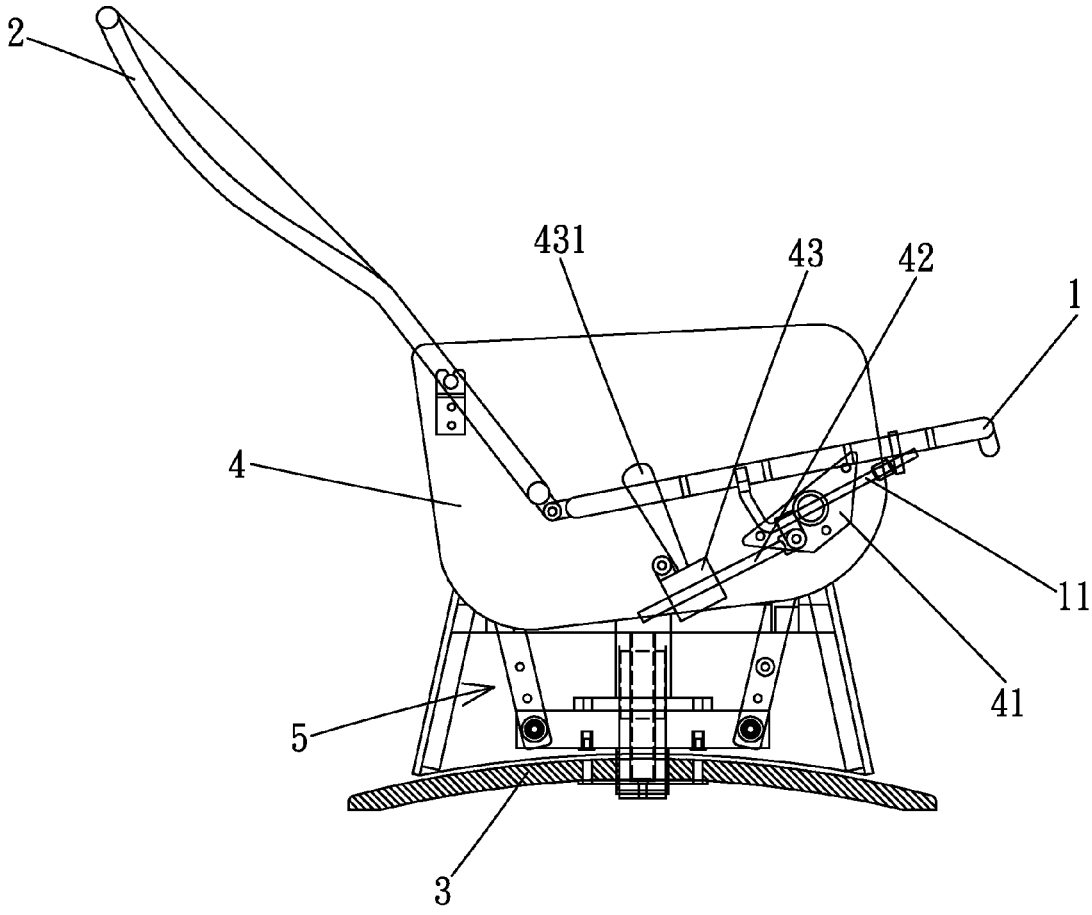
FIG. 14 is a schematic side view similar to FIG. 1 with an inclination angle of the backrest adjusted.

With reference to FIG. 13, to make the leisure rocking chair of the present invention in an unlocking state, the control rod 431 is operated to rotate the actuating rod 433 such that the abutting portions 4332 of the actuating rod 431 abut against the abutting portions 4342 of the pressing members 434. The pressing members 434 are shifted such that the inner periphery of the through-hole 4341 of each pressing member 434 disengages from the sliding rod 42. Thus, the sliding rod 42 can move relative to the guiding seat 43, and the angle of the backrest 2 can be adjusted. FIG. 14 shows the leisure locking chair after adjustment.

According to the foregoing, the leisure rocking chair of the present invention can rock and provide reliable locking. Although specific embodiments have been illustrated and described, numerous modifications and variations are still possible without departing from the essence of the invention. The scope of the invention is limited by the accompanying claims.

The invention claimed is:

1. A leisure rocking chair comprising a seat, a backrest, and a fixed base, with the backrest pivotably connected to the seat to form a structure allowing adjustment in an inclination angle, characterized in that the leisure rocking chair further comprises a rocking base and a rocking mechanism, wherein:

the fixed base includes a horizontal beam on an upper portion thereof and extending in a front/rear direction, the rocking mechanism includes front and rear rocking rods and a connecting rod, the front rocking rod has an upper end pivotably connected to a front end of the horizontal beam, the rear rocking rod has an upper end pivotably connected to a rear end of the horizontal beam, the front rocking rod has a lower end pivotably connected to an end of the connecting rod, the rear rocking rod has a lower end pivotably connected to another end of the connecting rod, a fixed support is mounted above an intermediate portion of the connecting rod, the rocking base is fixed to the fixed support, a positioning plate is mounted to the fixed base and faces sideways, the positioning plate includes a plurality of positioning holes arranged in a rocking direction of the rocking mechanism, the rocking mechanism includes an adjusting seat adjacent to the positioning plate, an adjusting lever is mounted to the adjusting seat and includes a tail portion extendible into one of the plurality of positioning holes to fix the rocking mechanism, the adjusting lever includes a control arm on a head portion thereof, wherein:

the adjusting seat includes a through-hole having an inclined end face, the adjusting lever is extended through the through-hole, the adjusting lever includes an inclined rotating portion engaged with the inclined end face of the through-hole for converting rotational movement of the adjusting lever into axial movement.

2. The leisure rocking chair as claimed in claim 1, wherein:

the inclined rotating portion is fixed around the adjusting lever, the inclined end face of the through-hole and the inclined rotating portion are located at an outer side of the through-hole, a limiting flange is formed on the adjusting lever and located at an inner side of the through-hole, a spring is mounted between the limiting flange and the adjusting seat.

3. The leisure rocking chair as claimed in claim 2, wherein tightening bolt is extended through a side of the inclined rotating portion to press against the adjusting lever.

4. The leisure rocking chair as claimed in claim 1, wherein the control arm is fixed perpendicularly to an end of the adjusting lever.

5. The leisure rocking chair as claimed in claim 4, wherein the control arm is located at an outer side of a lower portion of the rocking base.

6. A leisure rocking chair comprising a seat, a backrest, and a fixed base, with the backrest pivotably connected to the seat to form a structure allowing adjustment in an inclination angle, characterized in that the leisure rocking chair further comprises a rocking base and a rocking mechanism, wherein:

the fixed base includes a horizontal beam on an upper portion thereof and extending in a front/rear direction, the rocking mechanism includes front and rear rocking rods and a connecting rod, the front rocking rod has an upper end pivotably connected to a front end of the horizontal beam, the rear rocking rod has an upper end pivotably connected to a rear end of the horizontal beam, the front rocking rod has a lower end pivotably connected to an end of the connecting rod, the rear rocking rod has a lower end pivotably connected to another end of the connecting rod, a fixed support is mounted above an intermediate portion of the connecting rod, the rocking base is fixed to the fixed support, a positioning plate is mounted to the fixed base and faces sideways, the positioning late includes a plurality of positioning holes arranged in a rocking direction of the rocking mechanism, the rocking mechanism includes an adjusting seat adjacent to the positioning plate, an adjusting lever is mounted to the adjusting seat and includes a tail portion extendible into one of the plurality of positioning holes to fix the rocking mechanism, the adjusting lever includes a control arm on a head portion thereof, wherein:

the seat includes a guiding rod on each of two sides thereof, a sleeve is mounted to an inner surface of each of two sides of the rocking base and mounted around one of the guiding rods, a sliding rod is pivotably connected to one of the guiding rods, a guiding seat is mounted on the rocking base and receives the sliding rod, the guiding seat includes a switch device and a switch control rod for clamping or loosening the sliding rod, the rocking base is pivotably connected to an intermediate portion of the backrest.

7. The leisure rocking chair as claimed in claim 6, wherein: the switch device of the guiding seat includes a housing, an actuating rod, two pressing members, and two springs, the housing is fixed to the rocking base and includes a compartment, a through-hole, two engaging grooves, and an axial hole, the sliding rod extends through the through-hole of the housing, the actuating rod has an end engaged perpendicularly in the axial hole and is rotatable relative to the housing, another end of the actuating rod has an engaging portion engaged with the control rod, the actuating rod further includes two abutting portions on an outer periphery thereof and located in different angular positions and having a larger diameter, the two pressing members are two plates located in the compartment and engaged in the two engaging grooves, the actuating rod is mounted between the two pressing members, each of the two pressing members includes a through-hole having an inner diameter slightly larger than an outer diameter of the sliding rod, the sliding rod extends through the through-holes of the two pressing members, each of the two pressing members further includes an abutting portion in a location corresponding to the actuating rod, each of the two springs has two ends respectively abutting against an inner wall of the compartment and one of the two pressing members, the control rod is operable to rotate the actuating rod such that the abutting portions of the actuating rod is adjustable to abut against or not abut against the two pressing members and to control an inner periphery of the through-hole of each of the two pressing members to engage or not engage with the sliding rod.

* * * * *